United States Patent [19]

Jeng

[11] Patent Number: 4,809,570

[45] Date of Patent: Mar. 7, 1989

[54] ADJUSTABLE BOX WRENCH

[76] Inventor: Jiin N. Jeng, No. 26, Lane 167, Sec. 2, Bou-An., Shu-Lin Jenn, Taipei Hsien, Taiwan

[21] Appl. No.: 111,776

[22] Filed: Oct. 21, 1987

[51] Int. Cl.[4] ..... B25B 13/58

[52] U.S. Cl. ..... 81/185; 81/185.1; 81/185.2; 81/179; 269/275; 269/281

[58] Field of Search ..... 81/185, 185.1, 185.2, 81/179, 129, 176.1, 180; 269/275, 281

[56] References Cited

U.S. PATENT DOCUMENTS 1,314,044 8/1919 Buker ..... 81/185

*Primary Examiner*—Frederick R. Schmidt
*Assistant Examiner*—Maurina Rachuba
*Attorney, Agent, or Firm*—Ostrolenk, Faber, Gerb & Soffen

[57] ABSTRACT

An adjustable box wrench comprising a box body, an elastic steel beam, and adjustment fragment and a box arm. The adjustment fragment is adjustable inside a hole in the box body to form various size hexagonal holes. Teeth on opposite side of the hole and a beam with a slot permit adjustment of the position of the fragment to adjust hole size.

7 Claims, 2 Drawing Sheets

ADJUSTABLE BOX WRENCH

BACKGROUND OF THE INVENTION

The present invention relates to an adjustable box wrench for dismantling or assembling nuts in different sizes without any other adjusting tools.

A previous design uses hexagonal sleeves to dismantle or assemble the nuts. In order to fit the various sizes of nuts, the conventional hexagonal sleeves are designed into individual units. Using a suitable unit to fit a respective nut is obliviously inconvenient. Further, one must carry the whole supply of units in order to do the job efficiently when he goes outside and this becomes another problem.

SUMMARY OF THE INVENTION

A primary objective of the invention is to provide an adjustable box wrench having a simple construction and which is adjusted easily. In other words, the wrench provides a single sleeve which could be suitable for assembling or dismantling many nuts with different sizes.

Another objective of the present invention is to provide an adjustable box wrench which is convenient for a user to carry and to select the correct size to use.

A further objective of the present invention is to provide an adjustable box wrench which is economical in manufacturing cost because it is a single means rather than separate replaceable parts.

Further objectives and advantages of the present invention will become apparent as the following description proceeds, and the features of novelty which characterize the invention are pointed out with particularity in the claims annexed hereto.

DESCRIPTION OF THE PREFERRED EMBODIMENT

Figure 1:
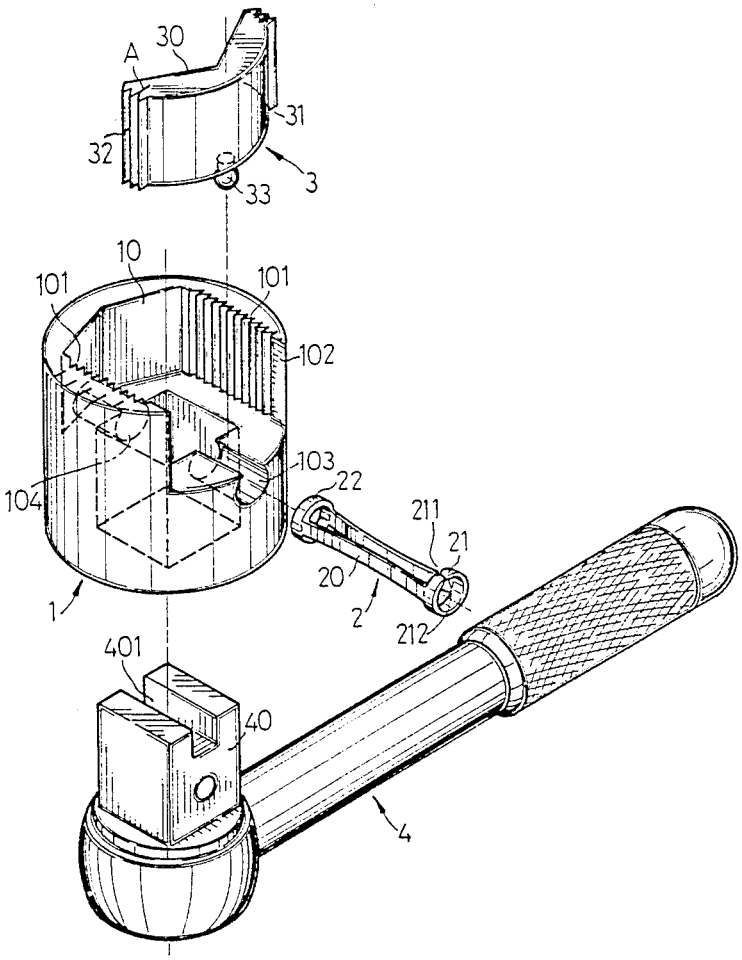
FIG. 1 is an exploded view of an adjustable box wrench in accordance with the present invention.

Referring to FIG. 1, it can be seen that the wrench of the present invention includes a box body 1, an elastic steel beam 2 extending across the body 1 toward its bottom, an adjustment fragment 3 and a box body support arm 4.

Figure 3:
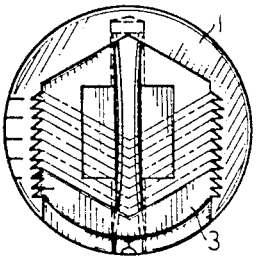
FIG. 3 is a plan view of a sleeve disposed on the adjustable box wrench in accordance with the present invention.

A polygon-shaped hole 10 is disposed on the box body 1. It provides a plurality of teeth 101 in parallel rows of equal respective distance on the both vertical faces inside the hole 10. The teeth 101 are triangular in cross-section with their lower edges, that is, those closest to the open side of the box straight in, while their upper edges, that is, those straight in, while their upper edges, that is, those away from the open side, are inclined, as can be seen in FIG. 3. The lowest tooth is provided as a rectangular tooth 102. Parallel to the two vertical faces of the hole 10, two apertures 103 and 104 are disposed on the box body 1 symmetrically. On both sides of the hole 10 on the box body 1 may be marked various symboles to indicate the different sizes of nuts.

The elastic beam 2 is made of steel. A crack 20 is formed in the central portion and two collars 21 and 22 provided on the respective ends of the steel beam 2 which extend into the apertures 103 and 104 on the box body 1. Two arc pieces 211 and 212 are provided on the collar 21. During assembly, the steel beam 2 is put into the box body 1 through the aperture 103 and thereafter accepted in the aperture 104. Then the end within the aperture 103 of the box body 1 is riveted to fix the steel beam 2.

The adjust fragment 3 is installed in the hole 10 of the box body 1 to completely form a hexagonal hole. Fragment 3 has its inside with a V-shaped face and outside face arc shaped. Teeth 32 having the complementary configuration to the teeth 101 on the box body 1 are provided on both sides of the adjust fragment 3. It is useful to mark a symbol (as signature A) for choosing the right sizes for the box body 1 to form the hexagonal hole in desired size. Further, a convex projection 33 under the bottom of the adjust fragment 3 engages within the crack 20 of the steel beam 2.

The box arm 4 has a connected means 40 disposed on one end to engage the box body 1. A concave depression 401 provided on the connected means 40 is inserted into box body 1 for snapping the convex 33 of the adjust fragment 3 and the crack 20 formed on the steel beam 2 and increasing the effect of the combination.

Figure 2:
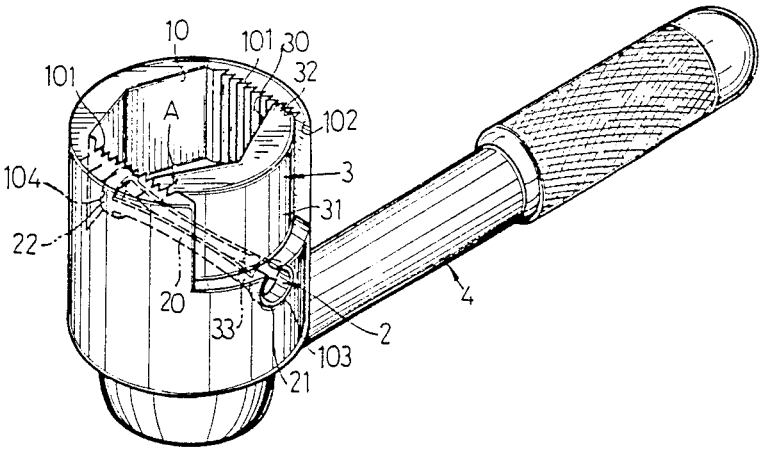
FIG. 2 is a perspective view of an adjustable box wrench in accordance with the present invention.

Referring to FIG. 2, after the assembly through the above procedure, one sees the preferred embodiment of the present invention. Further, referring to FIG. 3, it is adjustable by detaching the box arm 4 from the box body 1, then forcing the adjust fragment 3 upward and then repositioning the respective mark on the adjust fragment 3 (as signature A) and box body 1 (as signature B), forming the desired size to fit the respective nut. Again, putting the adjust fragment 3 into the crack 20 formed on the steel beam 2 and engaging them with the box arm 4, it is ready for use.

As shown in FIG. 3, there are eleven various sizes for a completed wrench (indicated by dotted lines) for efficient operation. One can only carry a single means to fit a plurality of nuts with different sizes for assembling or dismantling and obtain the great convenience.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. An adjustable box wrench comprising:

a box body having sides and including a shaped hole extending into one of the sides of the body; the shaped hole having a pair of opposite sides defining side walls of the hole, and each of the opposite sides having a plurality of teeth on it and extending in the direction into the hole; the box body hole having an open side between the opposite sides;

apertures defined through the box body below the top of the hole and generally parallel to the opposite sides of the hole; an elastic beam extending across the box body and to the apertures, the beam being elastically deformable inward;

an adjustment fragment placed in the box body for closing the open side of the hole; the fragment having an inside facing into the hole in the box body and defining one side of the hole and also having an outside facing out of the box body, the fragment having a fixture at the underside thereof for engaging with the beam for holding the fragment to the beam, the fragment further having opposite sides each respectively engaging one of the opposite sides of the hole in the box body; each fragment opposite side carrying teeth thereon, and the teeth on the opposite sides of the fragment being complementary to the respective engaged teeth defined on the opposite sides of the hole in the box body; and the box body sides having more teeth than the sides of the fragment, whereby the position of the fragment along the opposite sides of the box body is adjustable by selecting the box body teeth with which the fragment teeth are to be engaged, thereby for adjusting the size of the hole in the box body.

2. The wrench of claim 1, further comprising a box body arm connected with the box body by which the box body is movable.

3. The wrench of claim 1, wherein the beam has a crack defined in it and extending along its length and the fixture on the fragment for engaging the beam comprises a convex projection which projects into the crack for positioning the fragment.

4. The wrench of claim 1, wherein the teeth in the opposite sides of the hole in the box body each have an end that faces outwardly and toward the side at which the fragment is disposed which end is generally vertical, and the opposite end of each of the teeth is generally slanted.

5. The wrench of claim 1, wherein the inner side of the fragment is profiled and the box body hole having a side opposite the inner side of the fragment that is also cooperatingly profiled for together defining surfaces for producing a multi-sided hole in the box body.

6. The wrench of claim 1, further comprising symbols marked on the box body at locations along one of the opposite sides of the hole for the indicating size and shape holes to be formed by the box body.

7. The wrench of claim 3, wherein the beam has two breaches on one end which are inserted into the apertures of the box body and are riveted there.

* * * * *